US007086268B2

(12) United States Patent
Luckey, Jr. et al.

(10) Patent No.: US 7,086,268 B2
(45) Date of Patent: Aug. 8, 2006

(54) APPARATUS AND METHOD FOR REMOVING AND COOLING A PART FROM A FORMING TOOL

(75) Inventors: George Luckey, Jr., Dearborn, MI (US); Peter Friedman, Ann Arbor, MI (US); Richard Allor, Livonia, MI (US); Warren Copple, Trenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 197 days.

(21) Appl. No.: 10/708,628

(22) Filed: Mar. 16, 2004

(65) Prior Publication Data

US 2005/0204793 A1 Sep. 22, 2005

(51) Int. Cl.
*B21D 45/00* (2006.01)

(52) U.S. Cl. ..... 72/426; 72/60; 72/342.2; 72/709

(58) Field of Classification Search ..... 72/421, 72/709, 57, 421.1, 379.2, 60, 20.5, 422, 342.5, 72/342.3, 405.05, 342.2; 425/403.1; 264/237
See application file for complete search history.

(56) References Cited

U.S. PATENT DOCUMENTS

| | | | | |
|---|---|---|---|---|
| 3,529,458 | A | 9/1970 | Butler et al. | |
| 4,299,111 | A | 11/1981 | Fayal et al. | |
| 4,706,361 | A | 11/1987 | Meyer et al. | |
| 5,205,470 | A | 4/1993 | Cadwell | |
| 5,306,190 | A * | 4/1994 | Spina et al. | 72/364 |
| 5,392,630 | A * | 2/1995 | Marinoni et al. | 72/420 |
| 5,737,954 | A | 4/1998 | Yasui | |
| 6,619,094 | B1 * | 9/2003 | Juhl | 72/342.6 |
| 6,694,790 | B1 * | 2/2004 | Ryntz et al. | 72/60 |
| 6,799,450 | B1 * | 10/2004 | Brinas et al. | 72/342.2 |
| 2002/0152783 | A1 | 10/2002 | Kleber et al. | |
| 2003/0000275 | A1 | 1/2003 | Spence et al. | |
| 2003/0046966 | A1 | 3/2003 | Kleber | |

FOREIGN PATENT DOCUMENTS

| | | |
|---|---|---|
| DE | 37 36793 A1 | 10/1987 |
| JP | 3-230826 | 10/1991 |
| JP | 6335738 | 12/1994 |
| JP | 2001129617 | 5/2001 |

* cited by examiner

*Primary Examiner*—Derris H. Banks
*Assistant Examiner*—Teresa M. Bonk
(74) *Attorney, Agent, or Firm*—Raymond L. Coppiellie; Brooks & Kushman, P.C.

(57) ABSTRACT

An apparatus and method for removing a part from a forming tool and supporting the part. The apparatus includes a support member having a surface contoured to conform to a formed shape of the part and an aperture disposed in the surface. A manipulator moves the support member near the part while the part contacts the forming tool. Pressurized gas is directed toward the part to cause the release of the part from the forming tool and to cool the part. The surface supports the part to inhibit distortion as the part cools.

20 Claims, 3 Drawing Sheets

APPARATUS AND METHOD FOR REMOVING AND COOLING A PART FROM A FORMING TOOL

BACKGROUND OF INVENTION

1. Field of the Invention

The present invention relates to an apparatus for removing a part from a forming tool and supporting the part as it cools to maintain dimensional stability, and more particularly to an apparatus for removing a part from a superplastic forming tool without physical contact between the apparatus and the part.

2. Background Art

Forming methodologies, such as superplastic forming, are used to make various metal parts. Parts formed in a superplastic forming press tend to stick in the die in which they are formed. Previously, these parts were manually pried out of the die or were disengaged from the die using high velocity air as described in U.S. Pat. No. 6,615,631.

Prior part removal techniques suffered from various disadvantages. First, parts were not adequately supported to maintain dimensional tolerances and prevent distortion. Second, prior methodologies required that the forming press remain open for a long period of time to remove the part. The longer the press is open, the more thermal energy escapes, resulting in increased die reheating times, increased energy consumption, increased cycle time, and decreased process efficiency.

Before applicant's invention, there was a need for an apparatus and a method for quickly removing a part from a forming tool and for supporting the part in order to maintain dimensional stability. Problems associated with the prior art as noted above and other problems are addressed by applicant's invention as summarized below.

SUMMARY OF INVENTION

According to one aspect of the present invention, an apparatus for removing a part from a forming tool and supporting the part to maintain a formed shape is provided. The apparatus includes a support member having a surface contoured to conform to a formed shape of the part. An aperture is disposed in the surface for directing a pressurized gas toward the part to cool the part and cause the release of the part from the forming tool. A manipulator, which may be a robot, moves the support member a predetermined distance from the part while the part is in the forming tool. The surface supports the formed shape of the part when the part is removed from the forming tool to inhibit distortion of the part as the part cools.

The surface may be an open cell metal foam, a ceramic material, or a metal sheet formed in the forming tool to provide the surface contoured to conform to the formed shape of the part.

A sensor may be disposed adjacent to the surface for detecting the presence of the part after the part is released from the forming tool.

A manifold may be disposed adjacent to the surface and in fluid communication with the aperture and a source of pressurized gas. The pressurized gas may be provided at a first velocity or first flow rate to cause the release of the part and a second velocity or second flow rate to cool the part after release from the forming tool.

According to another aspect of the invention, an apparatus for releasing a part from a superplastic forming die without physical contact between the apparatus and the part is provided. The apparatus includes a part removal assembly, a manipulator, and a sensor. The part removal assembly has a contoured part receiving support and a manifold. The contoured part receiving support includes a plurality of apertures. The manifold is located adjacent to the contoured part receiving support and provides cooling air to the contoured part receiving support. The manipulator positions the part removal assembly. The sensor detects the release of the part from the superplastic forming die. Cooling air is directed by the plurality of apertures toward the part to cool the part until it is released from the superplastic forming die.

The cooling air may be provided after the part is released from the superplastic forming die. The cooling air may be provided at a substantially uniform velocity or substantially uniform flow rate through the plurality of apertures. The plurality of apertures may have the same shape and may be disposed parallel to each other.

According to another aspect of the invention, a method for removing a part from a forming tool and supporting the part to maintain a formed shape is provided. The method includes positioning an apparatus a predetermined distance from the part. A cooling gas is directed toward the part at a first velocity to cause the part to be released from the forming tool. After the release of the part is detected, the cooling gas is provided at a second velocity to facilitate uniform cooling of the part. The apparatus is moved away from the forming tool and the part is removed from the apparatus when the part is cooled to a temperature at which the part maintains the formed shape.

A first time period required to position the apparatus, provide the cooling gas at a first velocity, and detect the release of the part may be less than a second time period required to cool the part to a temperature at which the part independently maintains the formed shape.

The cooling gas may be provided at a first flow rate to cause the release of the part and at a second flow rate after the part is released to promote uniform cooling of the part. The first velocity or first flow rate may be less than or not equal to the second velocity or second flow rate.

DETAILED DESCRIPTION

Figure 1:
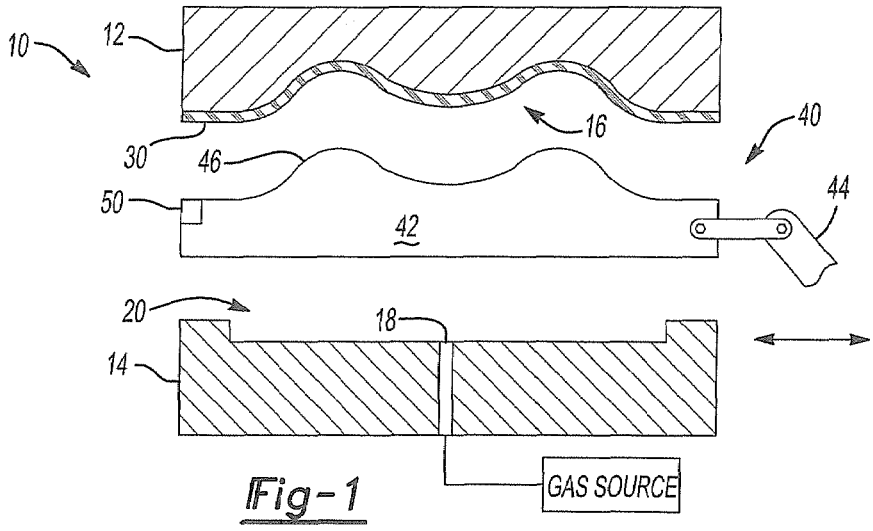
FIG. 1 is a section view of a forming tool and apparatus for removing and cooling a part.

Referring to FIG. 1, a forming tool 10 is shown. In one embodiment, the forming tool 10 is a superplastic forming tool. However, the forming tool 10 may be used with any suitable forming methodology, such as hot blow forming. Moreover, the forming tool 10 may be configured to form one or more parts having the same or different shapes.

The forming tool 10 includes a die 12 and a die lid 14. The die 12 includes a first cavity 16 having a predetermined shape. The die 12 may include multiple cavities for forming more than one part.

The die lid 14 includes an inlet 18 and a second cavity 20. The inlet 18 is adapted to provide a pressurized gas, such as air, to the second cavity 20. The second cavity 20 may be configured to mirror the perimeter of the first cavity 16.

A formed part 30 is shown contacting the die 12. More specifically, a metal sheet having superplastic characteristics is expanded into the first cavity 16 to form the part 30 using superplastic forming methodologies as are known by those skilled in the art. In superplastic forming, heat and pressure force the metal sheet against the first cavity 16 to form the part. For instance, the die 12 may be heated to a temperature near 500° C. to facilitate part formation. Due to the high temperature, pressure, and cavity shape, the formed part 30 may not release easily from the first cavity 16.

An apparatus 40 is provided to remove, support, and cool the part 30. The apparatus 40 includes a support member 42 and a manipulator 44. The support member 42 is connected to and positionable by the manipulator 44. The manipulator 44 may be any suitable device, such as robot.

Figure 4:
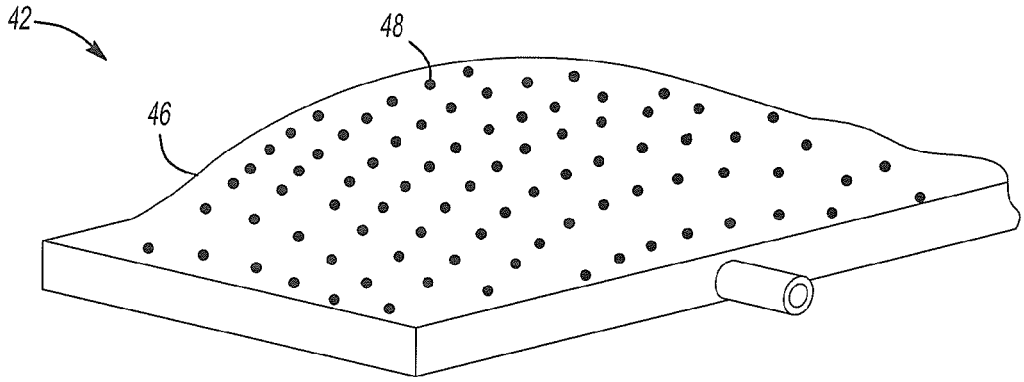
FIG. 4 is a perspective view of one embodiment of a support member of the apparatus.

Referring to FIGS. 1 and 4, one embodiment of the support member 42 is shown. The support member 42 has at least one contoured surface 46 that may be configured to match the shape of the part 30. At least a portion of the contoured surface 46 supports the part 30 when the part is released from the die 12 to maintain dimensional tolerances and inhibit warpage. A plurality of contoured surfaces may be provided to receive one or more parts made in the forming tool 10. The contoured surface 46 includes one or more apertures 48. The apertures 48 may have any suitable shape, spacing, and orientation. A cooling gas, such as air, is delivered through the apertures 48 to cause the release of the part 30 from the die as will be described in greater detail below.

The contoured surface 46 may be made in any suitable manner. For example, in the embodiment shown in FIG. 4, a sheet may be formed in the superplastic forming tool 10 and then provided with apertures using any suitable method, such as drilling or piercing. Alternately, the apertures may be provided before forming. The contoured surface 46 may be connected to a hollow chamber that provides the cooling gas to the apertures 48.

Figure 2:
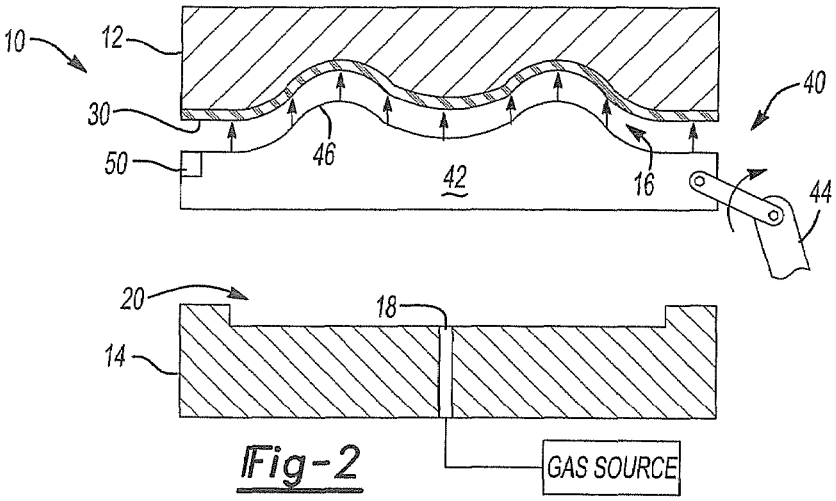
FIG. 2 is a section view of the forming tool with the apparatus in a raised position before the part is released.
Figure 3:
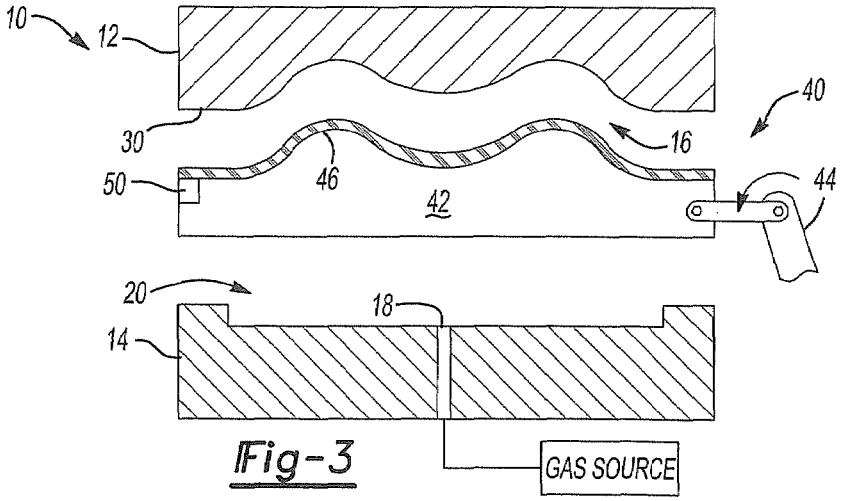
FIG. 3 is a section view of the forming tool with the apparatus in the lowered position after the part is released.

A sensor 50 may be disposed on the support member 42, manipulator 44, or in the die 12 to detect the release of the part 30 from the die 12. The sensor 50 may be of any suitable type, such as a proximity sensor, weight sensor, strain sensor, or temperature sensor. For example, a sensor may be disposed adjacent to the contoured surface 46 to detect the presence of the part as shown in FIGS. 1–3.

Figure 5:
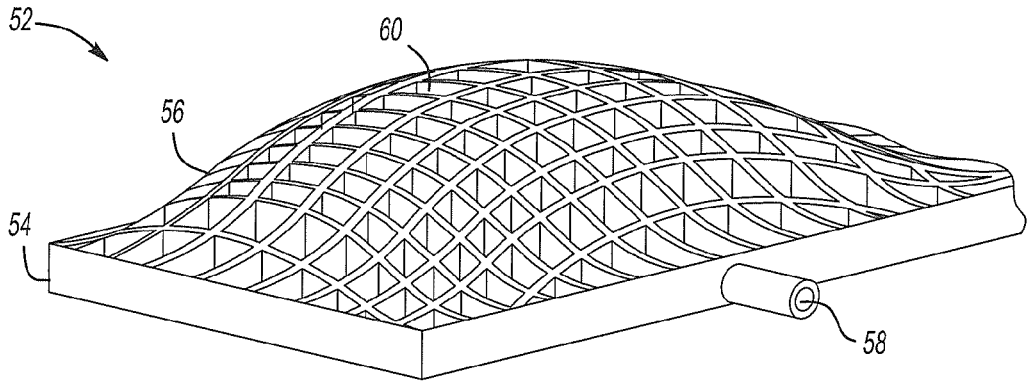
FIG. 5 is a section view of a second embodiment of the support member.

Referring to FIG. 5, another embodiment of the support member is shown. In this embodiment, the support member 52 includes a manifold 54 and a contoured support 56. Cooling gas enters the manifold 54 via an inlet 58. The inlet 58 may be attached to a source of pressurized gas, such as an air compressor, by a conduit, such as tubing or a hose (not shown). The contoured support 56 includes a plurality of apertures 60 positioned parallel to each other. However, the apertures 60 may have any suitable size or shape. For example, the apertures may have a honeycomb configuration.

Figure 6:
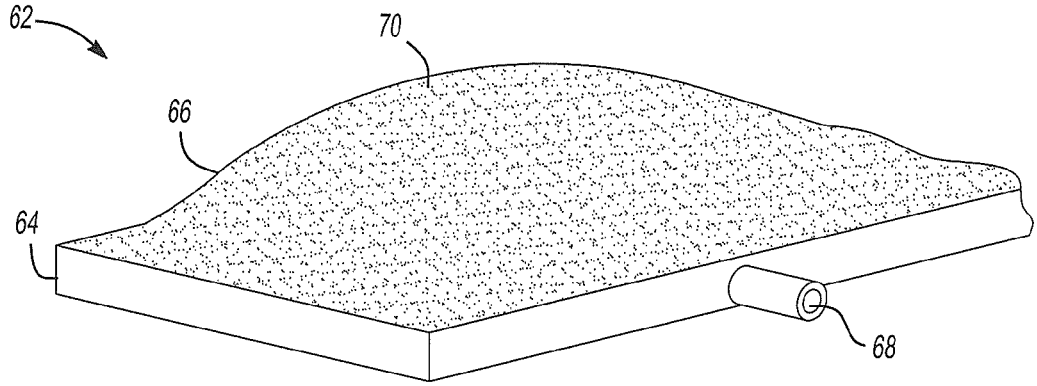
FIG. 6 is a section view of a third embodiment of the support member.
Figure 7:
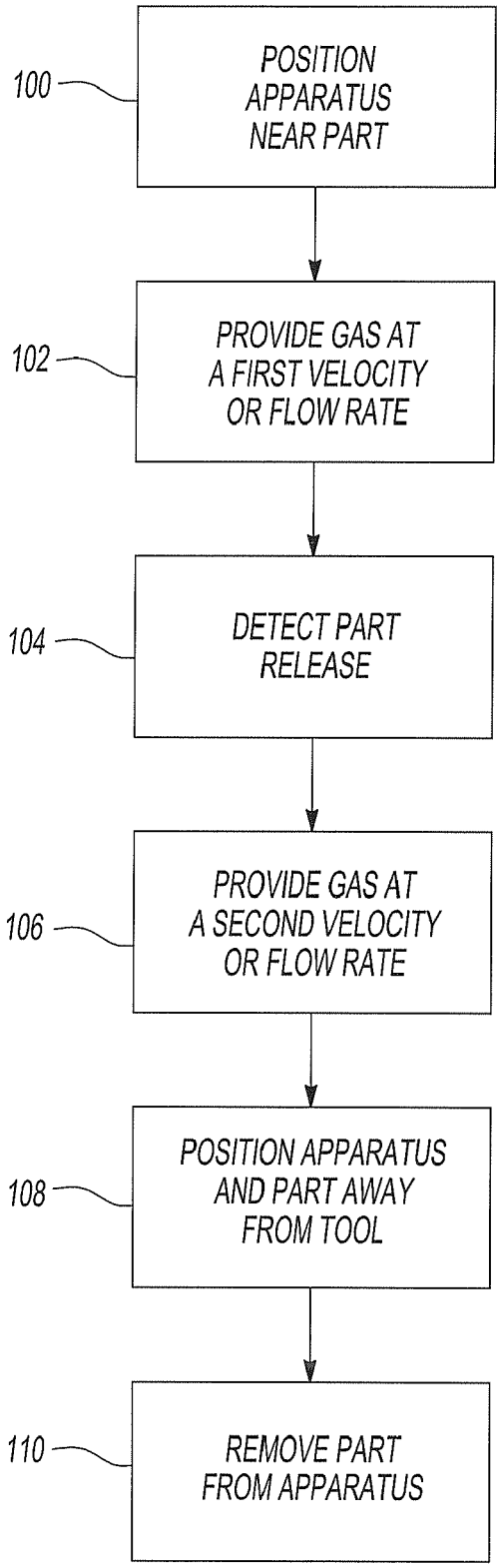
FIG. 7 is a flowchart of a method for removing the part from the forming tool and supporting the part.

Referring to FIG. 6, another embodiment of the support member is shown. In this embodiment, the support member 62 includes a manifold 64 and a contoured support 66. The contoured support 66 may be an open cell material, such as a polymeric foam, a ceramic matrix, or a metal foam like an aluminum metal foam. Cooling gas is provided to the manifold 64 via an inlet 68 in the manner previously described. The cooling gas exits the manifold 64 and passes through the contoured support 66 and exits through the contoured surface 70. Alternatively, the open cell material may be positioned between a contoured sheet like that shown in FIG. 4 and the manifold 64 to act as a diffusing medium.

Optionally, a fan may be disposed in the manifold 54, 64 to increase the velocity of the cooling gas.

The cooling gas may be provided at any suitable temperature, pressure, velocity, flow rate and/or for any suitable duration to cause the part 30 to release from the die 12. For instance, a pressure between 70 KPa to 400 KPa provided for 5 to 15 seconds has been sufficient to cause the release of various parts. To reduce heat loss when the forming tool 10 is open, it is desirable to use a cooling gas set at a relatively low flow rate so as not to substantially reduce the temperature of the die 12.

Referring to FIGS. 1–3 and 7, a method for removing, supporting, and cooling a part with the apparatus 40 will now be described. For clarity, this description is made with reference to the support member shown in FIG. 4. However, any embodiment of the support member may be employed.

At 100, the apparatus 40 is positioned near the part 30. More specifically, the apparatus 40 is moved from a retracted position where the support member 42 is outside the forming tool 10 to an advanced position where the support member 42 is located between the die and die lid 12, 14 as shown in FIG. 1. The horizontal arrow denotes the direction of travel between the advanced and retracted positions. The manipulator 44 moves the support member 42 from a lowered position shown in FIG. 1 to a raised position shown in FIG. 2 in which the support member 42 is positioned next to, but not in contact with the part 30. In the raised position, the support member 42 can be located any distance from the part 30 such that it provides a sufficient amount of cooled air to cause the part to release from the die 12. For example, the distance from the part may be in the range of 5 mm to 100 mm. In FIG. 2, the curved arrow denotes the direction of travel from the lowered position to the raised position.

At 102, cooling gas is provided through the apertures 48 at a first velocity, first flow rate, or first pressure. In FIG. 2, the cooling gas is represented by the vertical arrows. The first velocity, first flow rate, or first pressure is determined by experimentation and is set at a level sufficient to cause the release of the part from the die 12. The cooling gas cools the part 30 and causes it to contract due to the difference in the coefficient of thermal expansion between the part 30 and the die 12. The cooling gas may be uniformly distributed through the contoured surface 46 to inhibit warping or deformation of the part 30.

Referring to FIG. 3, when the part 30 contracts, it releases from the die 12 and drops onto the support member 42. The support member 42 provides dimensional support of the part immediately following its release from the die 12.

At 104, the release of the part 30 is detected using a sensor. Optionally, after the release of the part is detected, the part 30 may be secured to the support member 42 by mechanical devices, such as clamps (not shown).

At 106, cooling gas is provided at a second velocity, second flow rate, or second pressure to continue to cool the part 30 and to inhibit part deformation due to the temperature differential between the surface of the part contacting the apparatus 40 and the surface of the part exposed to the environment. The second velocity, second flow rate, or second pressure is set at a level sufficient to provide continued cooling of the part 30, but not so high that the part 30 is pushed off the apparatus 40. The second velocity, second flow rate or second pressure may be less than or equal to the first velocity, first flow rate, or first pressure. For instance, the second pressure may be approximately 30 KPa.

At 108, the apparatus 40 is moved away from the forming tool 10. More specifically, the support member 42 is moved to the lowered position as shown in FIG. 3 and then moved to the retracted position by the manipulator 44. The apparatus 40 may be rapidly removed from the forming tool 10 to reduce temperature loss of the forming tool 10.

The apparatus 40 may continue to hold the part 30 until the next press cycle is complete.

At 110, the part 30 is removed from the apparatus 40. The part may be removed in any suitable manner, such as by an operator or by providing the cooling gas at a third velocity, third flow rate, or third pressure sufficient to force the part 30 off the support member 42. Alternately, the manipulator 44 may turn the support member 42 upside down to disengage the part 30.

While the best mode for carrying out the invention has been described in detail, those familiar with the art to which this invention relates will recognize various alternative designs and embodiments for practicing the invention as defined by the following claims.

The invention claimed is:

1. An apparatus for removing a part from a forming tool and supporting the part to maintain a formed shape, the apparatus comprising:

a support member having a surface contoured to conform to a formed shape of the part and an aperture disposed in the surface for directing a pressurized gas toward the part to cool the part and cause the part to be released from the forming tool without being contacted by the support member; and a manipulator for moving the support member a predetermined distance from the part while the part contacts the forming tool;

wherein the surface supports the formed shape of the part when the part is removed from the forming tool to inhibit distortion as the part cools.

2. The apparatus of claim 1 wherein the surface is a metal sheet formed in the forming tool to provide the surface contoured to conform to the formed shape of the part.

3. The apparatus of claim 1 wherein the surface is an open cell metal foam.

4. The apparatus of claim 1 further comprising a sensor disposed adjacent to the surface for detecting the presence of the part after the part is released from the forming tool.

5. The apparatus of claim 1 further comprising a manifold disposed adjacent to the surface, the manifold in fluid communication with the aperture and a source of pressurized gas.

6. The apparatus of claim 1 wherein the manipulator is a robot.

7. The apparatus of claim 1 wherein the pressurized gas is provided at a first velocity to release the part and a second velocity to cool the part after release from the forming tool.

8. The apparatus of claim 1 wherein the pressurized gas is provided at a first flow rate to release the part and a second flow rate to cool the part after release from the forming tool.

9. An apparatus for releasing a part from a superplastic forming die without physical contact between the apparatus and the part, the apparatus comprising:

a part removal assembly having a contoured part receiving support and a manifold, the contoured part receiving support having a plurality of apertures and the manifold located adjacent to the contoured part receiving support and providing cooling air to the contoured part receiving support;

a manipulator for positioning the part removal assembly; and a sensor for detecting the release of the part from the superplastic forming die;

wherein cooling air is directed by the plurality of apertures toward the part to cool the part until it is released from the superplastic forming die.

10. The apparatus of claim 9 wherein the apparatus provides cooling air after the part is released from the superplastic forming die to cool the part and inhibit warpage.

11. The apparatus of claim 9 wherein the cooling air is provided at a substantially uniform velocity through each aperture.

12. The apparatus of claim 9 wherein the cooling air is provided at a substantially uniform flow rate through each aperture.

13. The apparatus of claim 9 wherein the plurality of apertures have the same shape.

14. The apparatus of claim 9 wherein the plurality of apertures are disposed parallel to each other.

15. A method for removing a part from a forming tool and supporting the part to maintain a formed shape with an apparatus, the method comprising:

positioning the apparatus a predetermined distance from the part;

directing a cooling gas toward the part at a first velocity with the apparatus to cause the part to be released from the forming tool;

detecting the release of the part from the forming tool;

providing the cooling gas at a second velocity to facilitate uniform cooling of the part;

moving the apparatus and part away from the forming tool; and removing the part from the apparatus when the part is cooled to a temperature at which the part independently maintains the formed shape.

16. The method of claim 15 wherein the predetermined distance is in a range of 6 mm to 50 mm.

17. The method of claim 15 wherein the first velocity is not equal to the second velocity.

18. The method of claim 15 wherein the cooling gas is provided at a first flow rate to cause the release of the part from the forming tool and a second flow rate after the part is released from the forming tool to promote uniform cooling of the part.

19. The method of claim 18 wherein the first flow rate is less than the second flow rate.

20. The method of claim 15 wherein a first time period required to position the apparatus, provide a cooling gas at a first velocity, and detect the release of the part is less than a second time period required to cool the part to a temperature at which the part independently maintains the formed shape.

* * * * *